United States Patent [19]

Sasaki

[11] Patent Number: 4,890,079

[45] Date of Patent: Dec. 26, 1989

[54] DI-ELECTRIC BANDPASS FILTER

[75] Inventor: Kanemi Sasaki, Tokyo, Japan

[73] Assignee: Kokusai Denki Kabushiki Kaisha, Tokyo, Japan

[21] Appl. No.: 246,448

[22] Filed: Sep. 19, 1988

[30] Foreign Application Priority Data

Oct. 26, 1987 [JP] Japan ..... 62-270960

[51] Int. Cl.[4] ..... H01P 1/202

[52] U.S. Cl. ..... 333/206; 333/202; 333/212

[58] Field of Search ..... 333/202, 206, 207, 208, 333/209, 210, 211, 212

[56] References Cited

U.S. PATENT DOCUMENTS 4,431,977 2/1984 Sokola et al. ..... 333/206

4,450,421 5/1984 Meguro et al. ..... 333/202

4,740,765 4/1988 Ishikawa et al. ..... 333/202 X

*Primary Examiner*—Eugene R. LaRoche

*Assistant Examiner*—Seung Ham

*Attorney, Agent, or Firm*—David O'Reilly

[57] ABSTRACT

This invention relates to a di-electric bandpass filter using a di-electric resonator for selecting a desired wave and removing an undesired wave. The di-electric resonator has one central conductive hole (10) for resonance and more than one non-metallized coupling bores (2, 2) which are provided at the open faces of plurality of resonators (1, 1, . . . 1) which are disposed so as to contact the respective earth faces of each other. Neighboring coupling bores (2, 2) are connected by coupling metal pieces (4), whith output and input matching pins (3) inserted into either coupling bores or central holes. In this invention, it is possible to dipose the resonators freely as constructed in a bandpass filter using the space effectively so that a compact installation can be realized.

17 Claims, 9 Drawing Sheets

DI-ELECTRIC BANDPASS FILTER

FIELD OF THE INVENTION

This invention relates to a di-electric bandpass filter using a di-electric resonator for selecting a desired wave and removing an undesired wave.

BACKGROUND OF THE INVENTION

Heretofore, in a multi-stage or section bandpass filter a plurality of di-electric resonators are integrally formed as shown in FIG. 17. The materials of the resonators are $(ZnSn)TiO_4$ series ceramics, BaO—PbO—$Nd_2O_3$—$TiO_2$ series ceramics etc. This filter is small but has the following defects.

1. Frequency adjustment due to the disorder of sintering (calcination) is required and for this purpose, hot side or earth side electrodes 13 or 14 (FIG. 17) of copper or silver are provided on the open face of the resonator. These hot side or earth side electrodes 13 or 14 are trimmed by scraping or shaving with a laser light, by sandblasting or a by cutting with diamond cutter. But laser trimming is expensive; sandblasting needs setting or adjusting of trimming time according to the thickness of the electrode and the work is not constant, and diamond cutter blades become clogged or choked with metal scraped from the electrode and needs troublesome maintenance.

2. Adjustment of bandpass width by changing the coupling between resonators is proposed by the following methods: that is, distance P between resonators as shown in FIG. 18(*a*) is changed, a recess 15 on the open face between resonators as shown in FIG. 18(*b*) is provided, recesses 16, 16 on the side faces between resonators as shown in FIG. 18(*c*) are provided, or a non-metallized bore 17 between resonators as shown in FIG. 18(*d*) is provided. However, these methods require long times for changing and adjusting the mold in which the resonator is molded.

3. For resolving the above problems, another method is proposed in which a plurality of resonators 18, 18 . . . 18 are coupled by base plate 19, as shown in FIG. 19. In this method, a certain amount of clearance between resonators 18 and base plate 19 is required to avoid frequency and coupling relation aberrations. But the presence of base plate 19 and the clearance required make the device bulky so it cannot be small like a small bandpass filter of the integral shaped type.

BRIEF DESCRIPTION OF THE INVENTION

This invention eliminates these drawbacks. One object of this invention is to provide a di-electric bandpass filter in which the period of development is short and it is not necessary to change the resonator mold so that a low cost device may be produced which can also be adapted to various types of small scale products.

Another object of the invention is to provide a small di-electric bandpass filter like a bandpass filter of the integral shaped type.

Another object of the invention is to provide a di-electric bandpass filter in which frequency trimming of a single resonator is possible and the number of retrimming times in constructing a bandpass filter is reduced so that trimming costs are low and mass production yield rate is improved.

Another object of the invention is to provide a di-electric bandpass filter in which each resonator is freely disposed so that a compact installation can be realized.

The above and other objects, advantages and novel features of this invention will be more fully understood from the following detailed description and the accompanying drawings, in which like reference numbers indicate like parts throughout wherein:

BRIEF DESCRIPTION OF THE DRAWINGS

FIG. 11(*b*) is a frequency characteristic curve according to the fifth and sixth embodiment of the invention.

DETAILED DESCRIPTION OF THE INVENTION

Figure 1A:
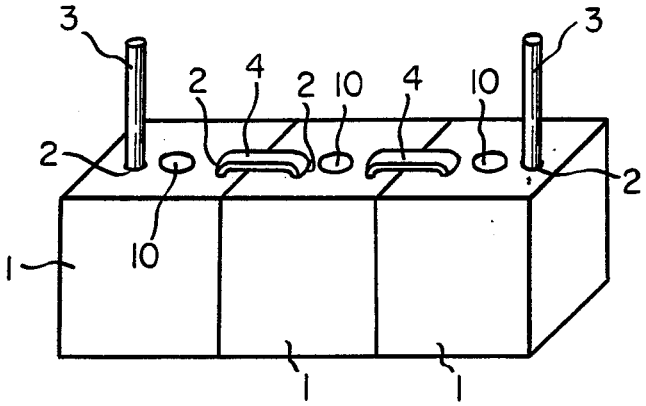
FIG. 1(*a*)(*b*) are a perspective view and a cross-sectional view respectively of a first embodiment of the invention.
Figure 1B:
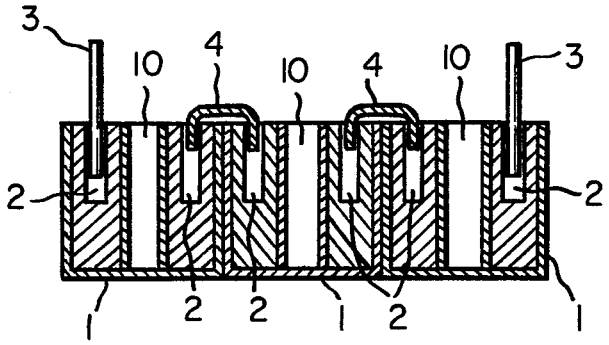
Figure 2A:
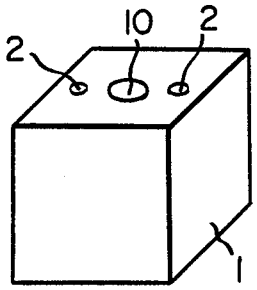
FIG. 2(*a*)(*b*) are a perspective view and a cross-sectional view respectively of a di-electric resonator used in the first embodiment of the invention.
Figure 2B:
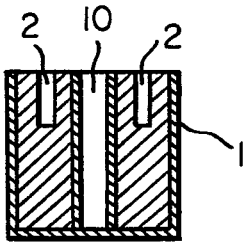

FIG. 1(*a*)(*b*) are a perspective view and a cross-sectional view respectively of the first embodiment of the invention. FIG. 2(*a*)(*b*) are a perspective view and a cross-sectional view respectively of a di-electric resonator used in the first embodiment of the invention.

In the first embodiment, one central conductive hole or bore 10 for resonance and two non-metallized coupling bores 2, 2 are provided at the opened faces of resonator 1 for constructing a coaxial di-electric resonator (see FIG. 2). Three resonators 1, 1, 1 are disposed so that their earth faces contact each other and neighboring coupling bores 2, 2 are connected by metal coupling pieces 4. Matching pins 3 are inserted into opposite ends of coupling bores 2, 2 respectively.

Figure 3A:
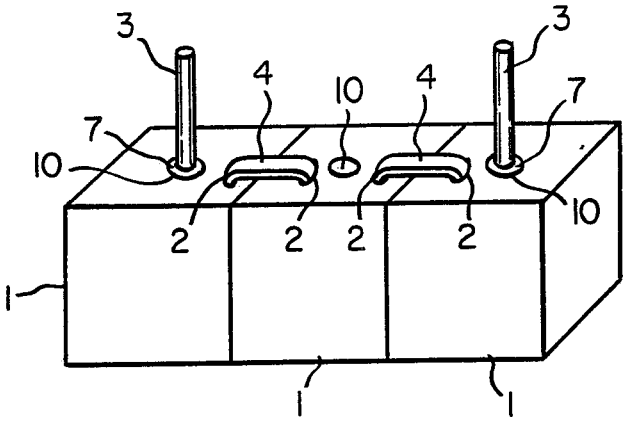
FIG. 3(*a*)(*b*) are a perspective view and a cross-sectional view respectively of a second embodiment of the invention.
Figure 3B:
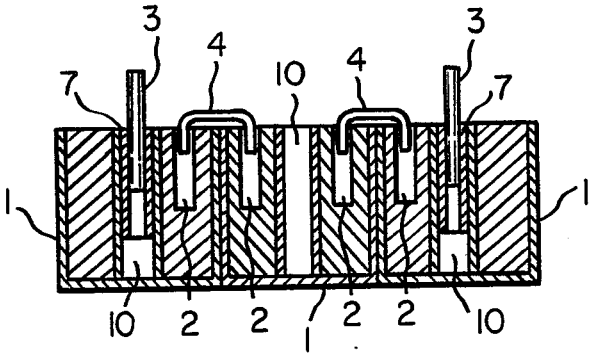

FIG. 3(*a*)(*b*) are a perspective view and a cross-sectional view respectively of a second embodiment of this invention.

In the second embodiment, one central conductive hole or bore 10 for resonance and one or more non-metallized coupling bores 2, 2 are provided at the opened faces of resonator 1 for constructing coaxial di-electric resonator (See FIG. 2). Three resonators 1, 1, 1 are disposed so their earth faces contact each other and neighboring coupling bores 2, 2 are connected by metal coupling pieces 4. Matching pins 3 are inserted into central conductive holes or bores 10, 10 respectively at opposite ends through insulating resin sleeves 7, 7. In this case, first and last resonators 1, 1 have only one coupling bore 2 and central resonator 1 has two coupling bores 2 (see FIG. 3).

Coupling bore 2 may pass through to the bottom face of resonator 1 the same as central conductive hole 10. Coupling bore 2 may be formed when molding resonator 1 with central conductive hole 10, therefore cost does not increase.

Figure 4A:
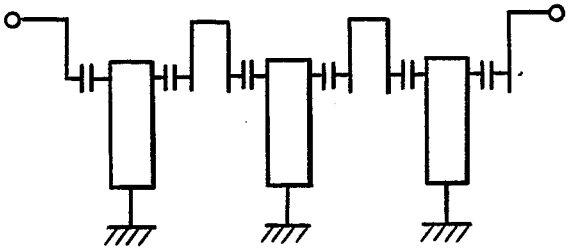
FIG. 4(*a*)(*b*) are an equivalent circuit and a general concentrated constant circuit respectively of the first and second embodiment shown in FIGS. 1 and 3 respectively of this invention.
Figure 4B:
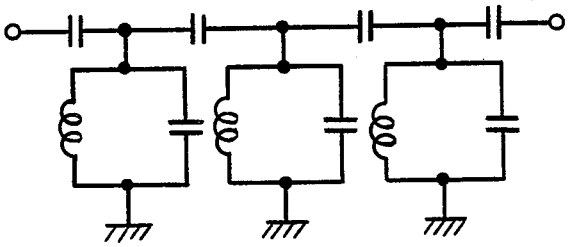

FIG. 4(*a*) is an equivalent circuit of the first and second embodiments and FIG. 4(*b*) is a general concentrated constant circuit of the first and second embodiments.

Figure 5:
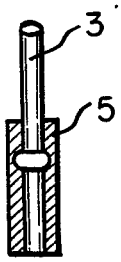
FIG. 5 is a cross-sectional view of a matching pin coated with resin.

In said first embodiment shown in FIG. 1 output and input matching pins 3 and metal coupling pieces 4 are secured with a resin adhesive. Alternatively, output and input matching pins 3 and metal coupling pieces 4 may be coated with synthetic resin 5 as shown in FIG. 5 and inserted by pressure into the respective holes or bores.

Figure 19:
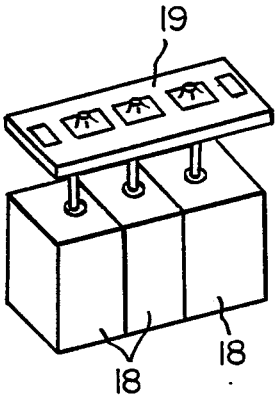
FIG. 19 is a perspective view of a prior art bandpass filter consisting of a resonator and coupling base plate.

To provide a di-electric bandpass filter of the invention according to various modes demanded, at first the required frequency of a single resonator is determined according to the specification demanded. The open face of resonator 1 is then ground to adjust the frequency. The dimension of output and input matching pins 3 and metal coupling pieces 4 to match the coupling amount is then determined. In prior bandpass filters, consisting of resonator 18, 18 and coupling base plate 19 shown in FIG. 19, trimming the resonator is required to adjust for aberrations of frequency due to fringe capacitance, but in this invention, less trimming is required because there is no change in the resonators open face.

This invention does not need the long time of development process as in the prior methods shown in FIG. 18, because changing and adjusting the mold in which the resonator is molded is not required. Moreover, since the height of the metal coupling pieces 4 from the open face is about 1 mm in a 10 mm cubic resonator, the device of this invention is as small as that of FIG. 18. Thus, this invention provides a di-electric bandpass filter having a short period of development and small size.

Figure 6:
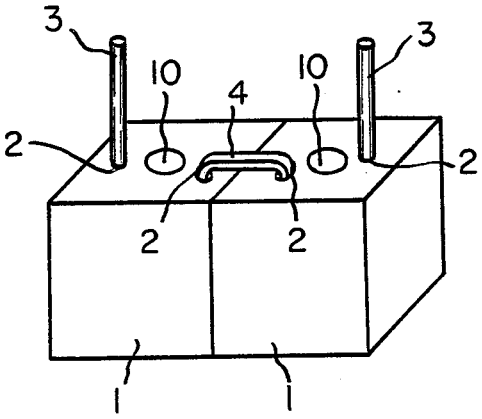
FIGS. 6 and 7 are perspective views respectively of third and fourth embodiments of a bandpass filter with two resonators constructed according to the invention.
Figure 8:
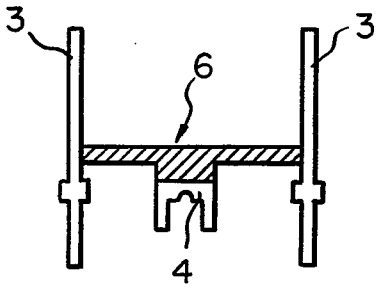
FIG. 8 is a cross-sectional view of a metal plate used in the third and fourth embodiment of the invention shown in FIGS. 6 and 7 respectively.

FIG. 6 shows the third embodiment of a bandpass filter of two resonators constructed according to the invention. In the third embodiment, a metal plate 4 and output and input matching pins 3 are integrally pressed in with metal plate 6 as shown in FIG. 8. Then metal plate 4 and matching pins 3 with metal plate 6 are inserted into both ends of coupling bores 2, 2 and central coupling bores 2, 2 of the two resonators 1, 1 respectively. The hatched portion shown in FIG. 8 is then removed by a cutter.

Figure 7:
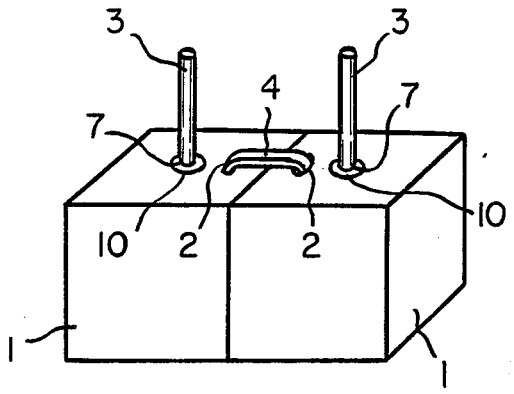

FIG. 7 shows a fourth embodiment of a bandpass filter having two resonators constructed according to the invention. In this embodiment metal plate 4 and output and input matching pins 3 are integrally pressed in with metal plate 6 as shown in FIG. 8. Matching pins 3 and metal plate 4 with metal plate 6 are then inserted into insulator sleeve 7 and coupling bore 2, 2 of resonators 1, 1 respectively. The hatched part shown in FIG. 8 is then removed by a cutter.

In these third and fourth embodiments, the amount of coupling is stabilized making the cost low, therefore, these embodiments are suitable for mass production.

Figure 9:
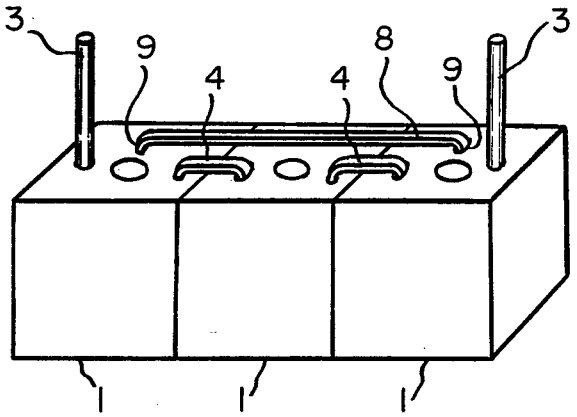
FIGS. 9 and 10 are perspective views of fifth and sixth embodiments of a bandpass filter having three resonators constructed according to the invention.

FIG. 9 shows a perspective view of the fifth embodiment of a bandpass filter having three resonators constructed according to the invention. In the fifth embodiment, indirect coupling bores 9, 9 are provided at the open faces of first and last resonators 1, 1 and are coupled by indirect coupling metal piece 8 to polarize the bandpass filter.

Figure 10:
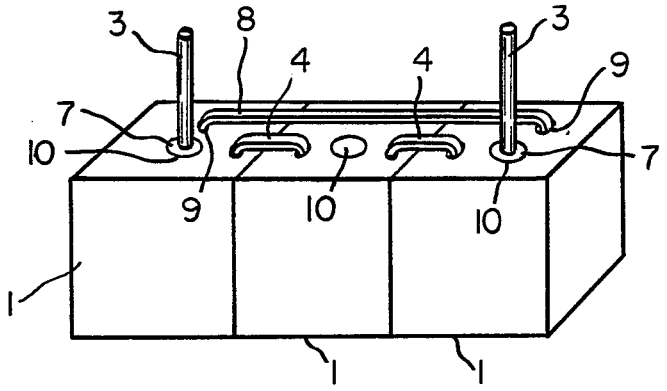

FIG. 10 is a perspective view of a sixth embodiment of the invention of a bandpass filter constructed according to the invention having three resonators. In this embodiment, indirect coupling bores 9, 9 are provided at the open faces of the first and last resonators 1, 1 connected by indirect coupling platinum metal piece 8 and insulator sleeve 10 is provided to polarize the bandpass filter.

Figure 11A:
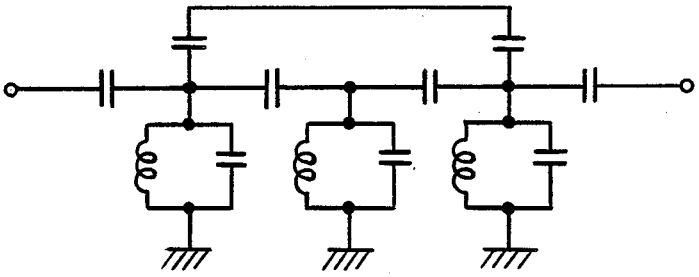
FIG. 11(*a*) is a equivalent circuit according to the fifth and sixth embodiment of the invention.
Figure 11B:
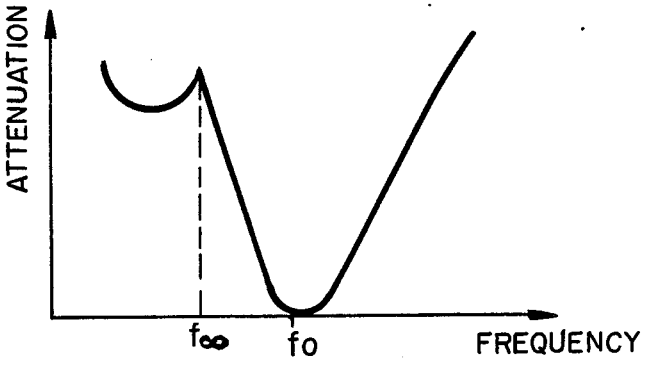

FIG. 11(*a*) is an equivalent circuit of the fifth and sixth embodiments.

FIG. 11(*b*) is a graph of the frequency characteristic curve of the fifth and sixth embodiments.

In the fifth and sixth embodiments, it is possible to set transmission zero point f at a lower frequency than resonant frequency fo and to obtain the necessary attenuation with less resonator. The value of the resonant frequency fo can be controlled by adjusting the length of indirect coupling metal piece 8 inserted into the indirect coupling bores 9, 9.

Figure 12A:
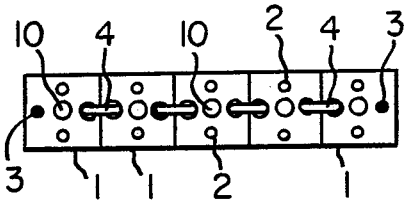
FIGS. 12(*a*)(*b*)(*c*) and 13(*a*)(*b*)(*c*) are plan views respectively of seventh and eighth embodiments according to the invention in which many resonators with a variety of dispositions are used.
Figure 12B:
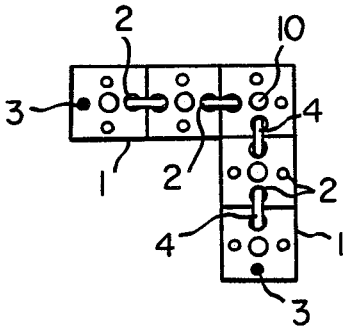
Figure 12C:
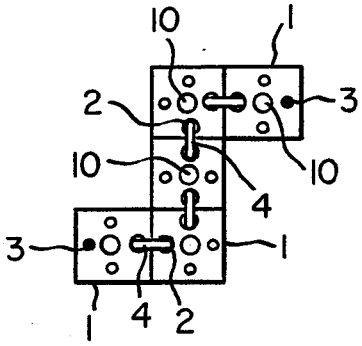

FIG. 12(*a*)(*b*)(*c*) are a seventh embodiment of the invention using multiple resonators, for example five, with a variety of their disposition. Each resonator has four coupling bores 2, 2, . . . 2 around the vicinity of the center of each open face.

Figure 13A:
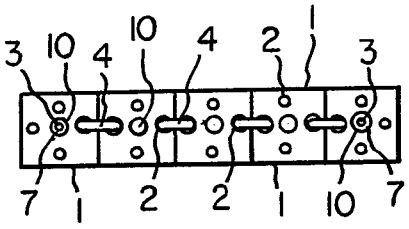
Figure 13B:
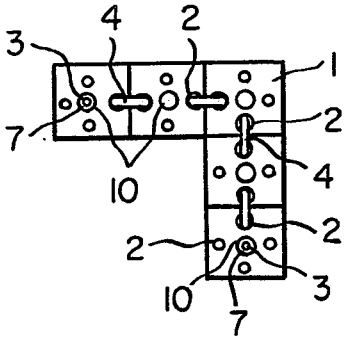
Figure 13C:
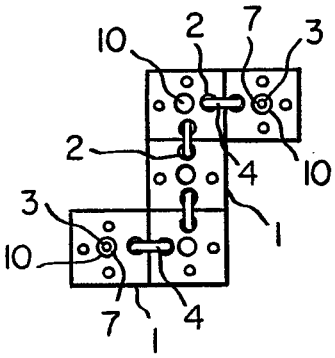

FIG. 13(*a*)(*b*)(*c*) is an eighth embodiment of the invention using multiple resonators, for example five, with a variety of disposition. Matching pins 3 are inserted into central conductive holes 10, 10 of the resonators at opposite ends respectively, through resin insulator sleeves 7, 7. As explained above, it is possible to dispose the multiple resonators freely in a bandpass filter constructed according to the invention to use space effectively so a compact installation can be realized.

Figure 14:
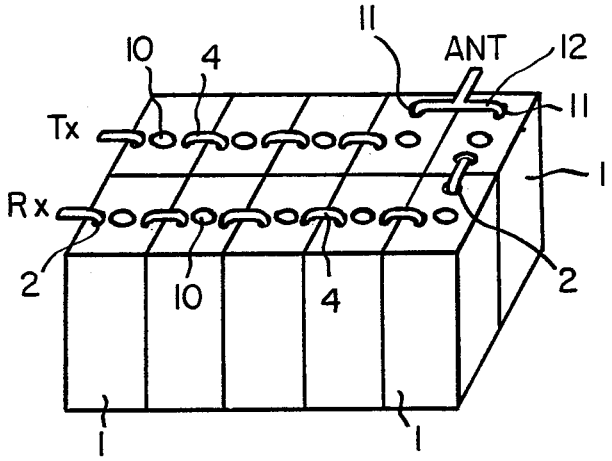
FIGS. 14 and 15 are perspective views of embodiments of the invention constructed as bandpass filters according to the invention used for an antenna duplexer.
Figure 15:
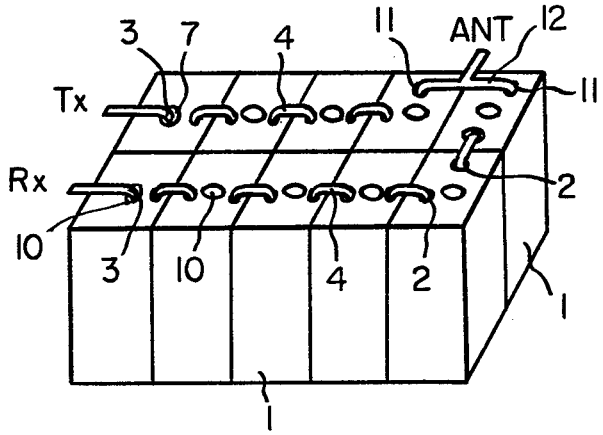
Figure 16:
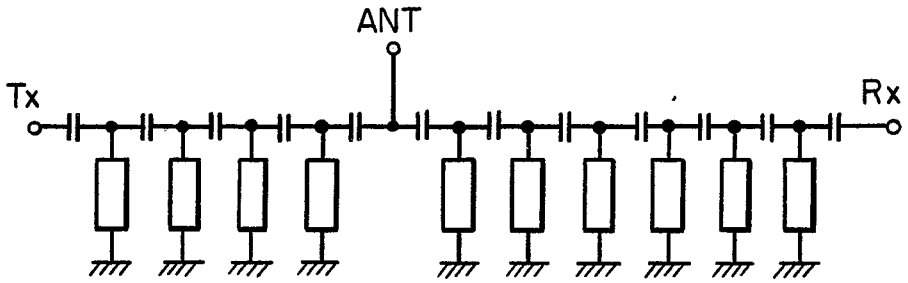
FIG. 16 is a circuit equivalents of the devices shown in FIGS. 14 and 15.
Figure 17:
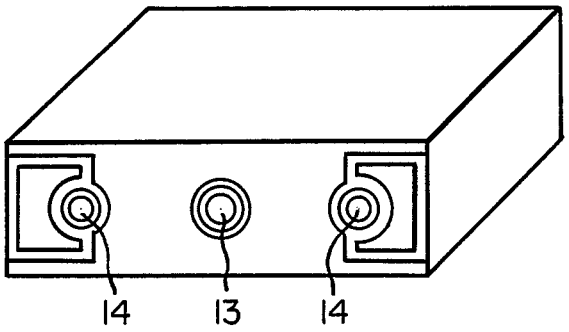
FIG. 17 is a perspective view of a prior art integral molded type bandpass filter.
Figure 18A:
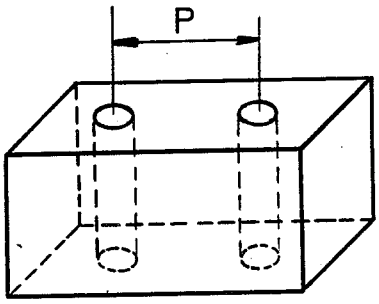
FIG. 18(*a*)–(*d*) illustrate methods to control coupling in prior art integral molded type bandpass filters.
Figure 18B:
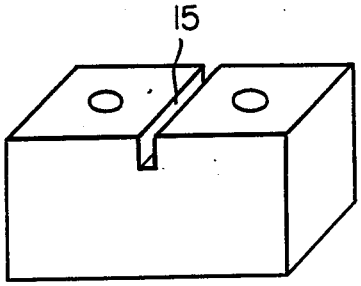
Figure 18C:
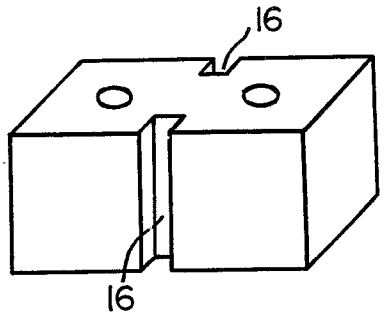
Figure 18D:
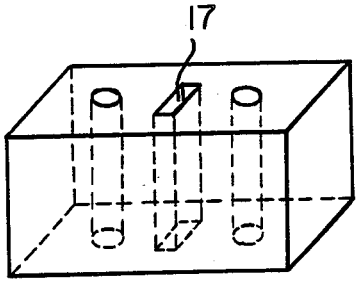

FIGS. 14 and 15 are perspective views of embodiments of the invention of a bandpass filter constructed according to the invention used as an antenna duplexer. In these embodiments, for example ten resonators 1 are associated. At the open faces of intermediate resonators 1, for example, fourth and fifth resonators 1, antenna coupling holes 11, 11 are provided and the antenna coupling holes 11, 11 are coupled by antenna coupling piece 12. FIG. 16 shows an equivalent circuit of the device shown in FIGS. 14 and 15.

In these embodiments, a small antenna duplexer having features of the seventh and eighth embodiment as shown in FIGS. 12 and 13 can be achieved. Moreover, when indirect coupling holes are provided at the open face of the first and last resonators, and these indirect coupling holes are coupled by a coupling metal piece, as shown in the fifth and sixth embodiment shown in FIGS. 9 and 10, a high efficiency antenna duplexer can be obtained.

This invention is not to be limited by the embodiment shown in the drawings and described in the description which is given by way of example and not of limitation, but only in accordance with the scope of the appended claims.

What is claimed is:

1. A di-electric bandpass filter, in which one central conductive bore (10) for resonance and one or more non-metallized coupling bores (2, 2) are provided in an open face of a plurality of di-electric resonators (1, 1), said plurality of di-electric resonators (1, 1) being disposed so that the respective earth faces of adjacent di-electric resonators are in contact; said one or more non-metallized coupling bores (2, 2) of adjacent di-electric resonators being connected by coupling metal pieces (4, 4), and output and input matching pins (3) being inserted into one of said bores (2, 10) in the first and last of said di-electric resonators (1, 1) respectively.

2. A di-electric bandpass filter as claimed in claim 1, in which said output and input matching pins (3) are inserted into said non-metallized coupling bores (2, 2) of the first and last of said plurality of di-electric resonators (1, 1) respectively.

3. A di-electric bandpass filter as claimed in claim 1, in which said output and input matching pins (3) are inserted through an insulator (7) into each said central conductive bore (10, 10) of the first and last of said plurality of di-electric resonators (1, 1) respectively.

4. A di-electric bandpass filter as claimed in claim 2 or 3, in which additional coupling bores (9, 9) are provided at the open faces of said first and last of said plurality of di-electric resonators (1, 1) said additional coupling bores (9, 9) being coupled by an additional coupling metal piece (8).

5. A di-electric bandpass filter as claimed in claim 2 or 3, in which antenna coupling holes (11, 11) are provided in an open face of one or more intermediate resonators of said plurality of di-electric, said antenna coupling holes (11, 11) being coupled by an antenna coupling piece (12).

6. A di-electric bandpass filter comprising; a plurality of di-electric resonators having an open face and at least one earth face; (1) a central conductive bore (10) and one or more coupling bores (2) provided in said open face; said plurality of di-electric resonators (1) having adjacent earth faces respectively in contact with one another; respective adjacent di-electric resonators (1) being coupled by a metal coupling (4) inserted in said coupling bores (2) of adjacent di-electric resonators (1); and input and output matching pins (3) inserted in a bore of the first and last resonators respectively of said plurality of di-electric resonators (1); whereby adjacent resonators can be disposed to produce the most compact installation.

7. The di-electric bandpass filter according to claim 6 in which said input and output matching pins (3) are in said coupling bores (2) of said first and last di-electric resonator respectively of said plurality of di-electric resonators.

8. The di-electric bandpass filter according to claim 6 including; an insulator (7) in each of said central conductive bores (10); said input and output matching pins (3) being inserted through said insulators (7) into said central conductive holes of said first and last resonators respectively of said plurality of di-electric resonators.

9. The di-electric bandpass filter according to claim 7 including additional coupling bores (9, 9) in at least said first and last resonators of said plurality of di-electric resonators (1) respectively; and an additional coupling metal piece (8) inserted in and coupling said indirect coupling bores.

10. The di-electric bandpass filter according to claim 8 including additional coupling bores (9, 9) in at least said first and last resonators of said plurality of di-electric resonators (1) respectively; and an additional coupling metal piece (8) inserted in and coupling said additional coupling bores.

11. The di-electric bandpass filter according to claim 7 including antenna coupling bores (11) in an open face of a pair of intermediate resonators (1) of said plurality of di-electric resonators (1); and an antenna coupling piece (12) inserted in and coupling said antenna coupling bores.

12. The di-electric bandpass filter according to claim 8 including antenna coupling bores (11) in an open face of a pair of intermediate resonators (1) of said plurality of di-electric resonators (1); and an antenna coupling piece inserted in and coupling said antenna coupling bores.

13. The di-electric bandpass filter according to claim 7 in which there are at least three of said plurality of di-electric resonators (1).

14. The di-electric bandpass filter according to claim 13 in which there are five of said plurality of di-electric resonators.

15. The di-electric bandpass filter according to claim 8 in which there are at least three of said plurality of di-electric resonators (1).

16. The di-electric bandpass filter according to claim 15 in which there are five of said plurality of di-electric resonators.

17. The di-electric bandpass filter according to claim 11 in which there are ten of said plurality of di-electric resonators (1); said antenna coupling bores being in the fifth and sixth adjacent resonators (1).

* * * * *